US006682465B2

(12) United States Patent
Hawthorne

(10) Patent No.: US 6,682,465 B2
(45) Date of Patent: Jan. 27, 2004

(54) SWING TRAINING AND EXERCISING APPARATUS

(75) Inventor: Keith E. Hawthorne, Cumming, GA (US)

(73) Assignee: GolfCoach Inc., Tucker, GA (US)

( * ) Notice: Subject to any disclaimer, the term of this patent is extended or adjusted under 35 U.S.C. 154(b) by 351 days.

(21) Appl. No.: 09/888,512

(22) Filed: Jun. 26, 2001

(65) Prior Publication Data

US 2002/0198086 A1 Dec. 26, 2002

(51) Int. Cl.[7] ..... A63B 69/36
(52) U.S. Cl. ..... 482/121; 482/136; 482/51
(58) Field of Search ..... 482/137, 121–123, 482/92, 142, 130, 140, 129, 136, 51, 64, 52

(56) References Cited

U.S. PATENT DOCUMENTS

| | | | | |
|---|---|---|---|---|
| 5,050,874 A | | 9/1991 | Fitch | 272/136 |
| 5,074,551 A | * | 12/1991 | Olschansky | |
| 5,284,464 A | | 2/1994 | Lee, III et al. | 482/121 |
| 5,354,252 A | * | 10/1994 | Habing | |
| 5,624,361 A | * | 4/1997 | Lai | |
| 6,015,372 A | * | 1/2000 | Steffee | |

* cited by examiner

*Primary Examiner*—Jerome W. Donnelly
(74) *Attorney, Agent, or Firm*—Welsh & Flaxman LLC

(57) ABSTRACT

An improved variable tension swing training and exercising apparatus which uses a primary resistance system and an adjustable secondary resistance to accommodate a number of golfers, having a wide range of physical characteristics and strength. The resistance is connected to a rotatable swing arm permitting a golfer to simulate a golf swing while exercising the golf muscles.

8 Claims, 4 Drawing Sheets

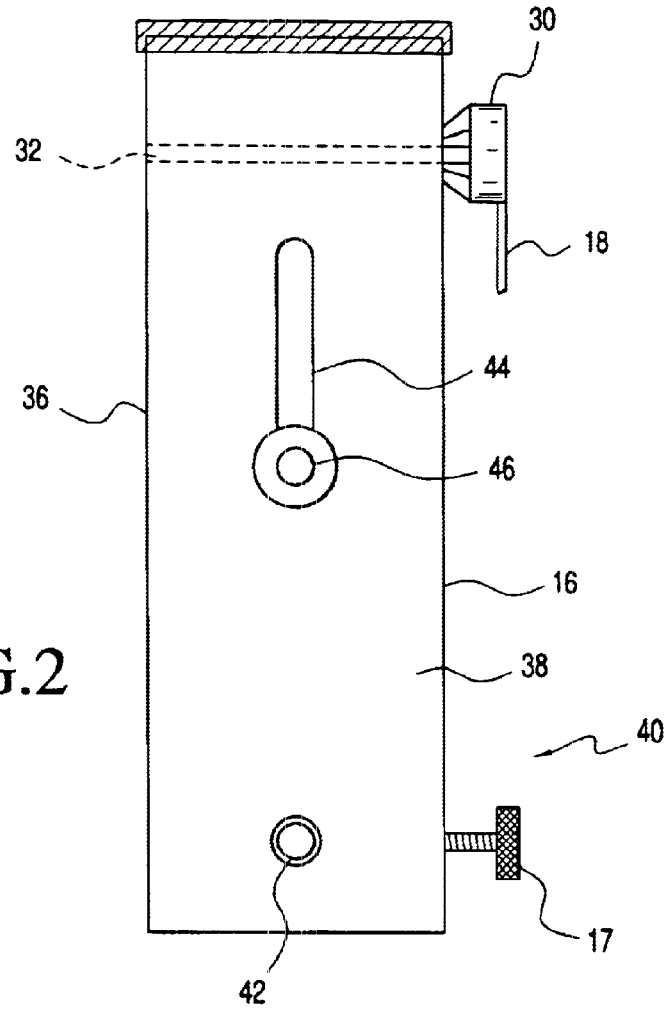
FIG.2
FIG.3
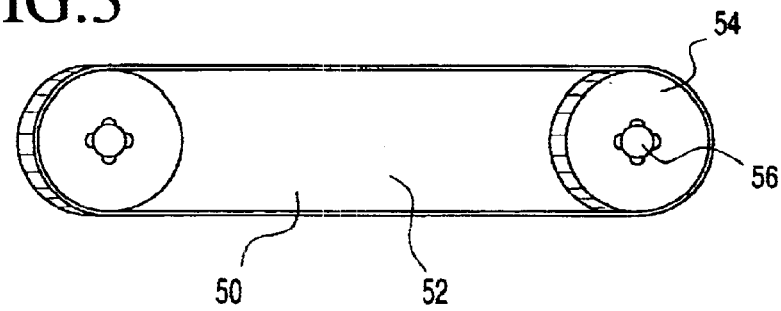
FIG.4
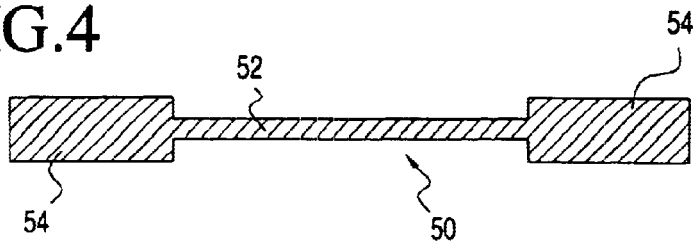

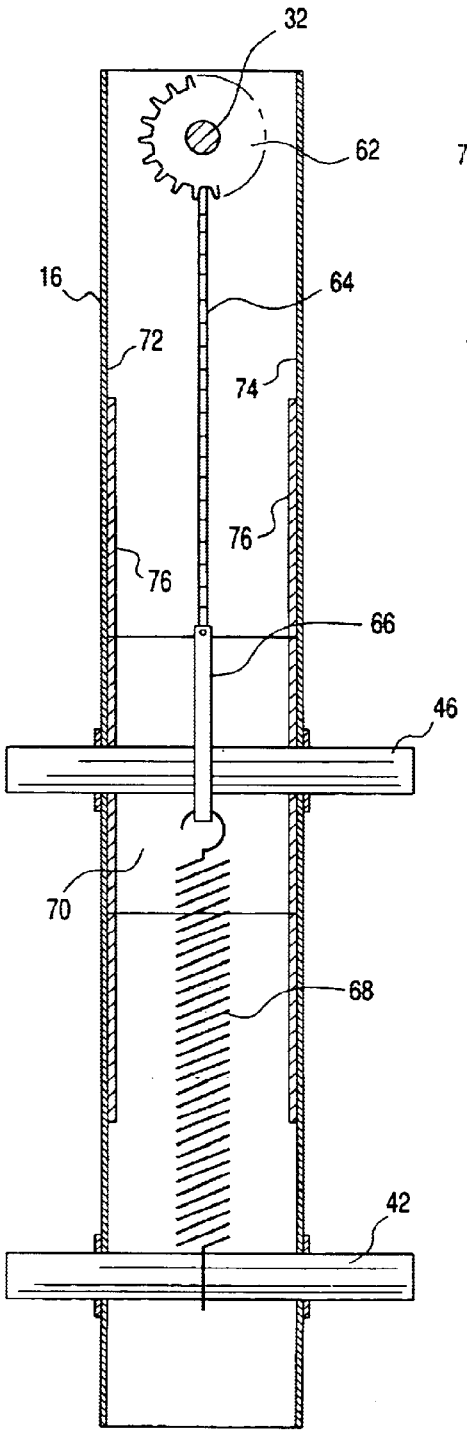
FIG.6
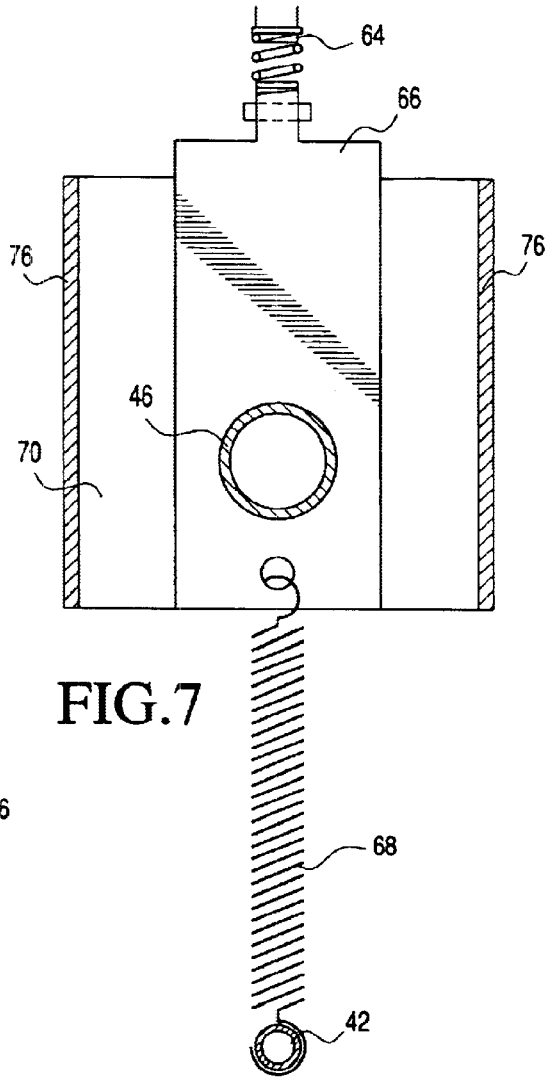
FIG.7
FIG.5
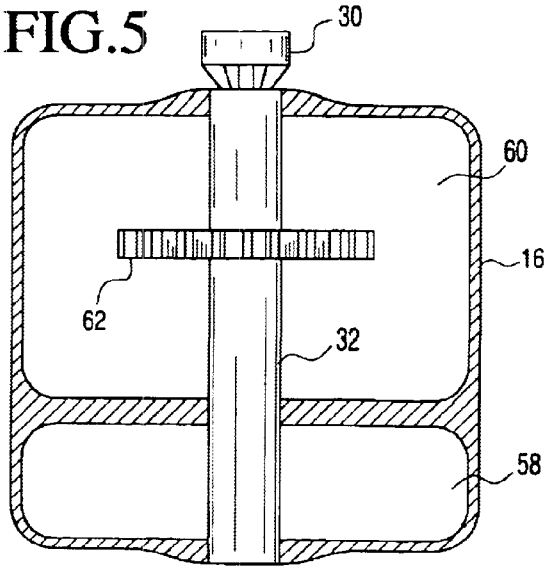

SWING TRAINING AND EXERCISING APPARATUS

BACKGROUND OF THE INVENTION

The present invention relates to a golf swing training and muscle exercising apparatus which is adjustable to enable a variety of users of various heights and strengths to simulate the movements of a proper golf swing. The apparatus also exercises the muscles of a golfer when swing movements are performed.

The present invention is an improvement over U.S. Pat. No. 5,050,874 issued to Robert E. Fitch and U.S. Pat. No. 5,284,464 issued to George P. Lee, III et al.

In U.S. Pat. No. 5,284,464 a golf swing training and exercising apparatus is disclosed including a base platform, an upright housing having a rotating parabolic arm connected between a simulated golf grip and a resistance source mounted in the housing, which enables a golfer to execute a simulated golf swing by rotating the arm against the resistance. The structure includes a linkage which permits rotation of the swing arm in either a back swing or down swing direction against the resistance. Further, this patent discloses a limited tension adjustment apparatus in the form of a tension arm designed to be located within a series of slots. However, this adjustment is limited whereby a swing training and exercising apparatus designed for a strong man could not be used by a woman or a child or for that matter, a man with reduced strength.

SUMMARY OF THE INVENTION

The present invention provides a golf swing training and exercise apparatus for simulating a proper golf swing path and for exercising the golf swing muscles and includes a base, a housing connected to said base and extending upwardly therefrom, a primary resistance system and a linkage system supported in the housing, the linkage system being operably connected to the resistance system, a swing arm having a proximal end rotatably attached to the linkage system and a grip on a distal end thereof, the linkage system being movable in either a clockwise or counterclockwise direction against said primary resistance system and a secondary resistance means removably attached to said apparatus to operate in conjunction with said primary resistance system.

The present invention further provides an improved variable tension swing training and exercising apparatus which provides a wide range of adjustable resistance via a primary resistance system which works in conjunction with a secondary removable resistance system to accommodate a number of golfers, having a wide range of physical characteristics and strength, including women and children as well as men having well developed muscles and superior strength associated therewith.

The improvement of the present invention uses a secondary resistance which adds tension to the primary resistance for increasing the overall resistance for well developed users. Preselected resistive force bands are connected between a movable force band rod and a fixed force band rod. The fixed force band rod is connected toward a lower end of the housing and also serves as a mount for an internal spring. The movable force band rod extends through a pair of slots in the apparatus housing and is accessible outside the housing. The movable force band rod is mounted on an internal rod carriage block and is connected to the rotatable swing arm through the sprocket, chain and rod connector.

Selected force bands are attached between the fixed and movable force band rods to provide a selected resistance for a particular golfer using the apparatus.

In use, a golfer selects a force band having a particular resistance. The ends of the force bands are provided with suitable connectors whereby one end of the force band is placed on the fixed force band rod and the other end of the force band is placed on the movable force band rod. Once a force band resistance is selected for a particular golfer using the apparatus, it is attached between the fixed and movable force band rods. Then the golfer may use the swing training and exercising apparatus either in a simulated back swing or down swing mode by rotating the parabolic swing arm in either a back swing or down swing direction in accordance with a specific exercise being performed. Rotation of the parabolic swing arm, in turn, rotates the shaft and sprocket to extend the movable rod against the resistance.

An object of the present invention is to provide a swing training and exercise apparatus using a primary resistance system and an adjustable secondary resistance to accommodate a number of golfers having a wide range of physical characteristics and strengths.

It an object of the present invention to provide a swing training and exercise apparatus wherein the secondary resistance means is connected between a fixed support extending from said housing and a movable support connected to the linkage system and extending from the housing.

It is another object of the present invention to provide an apparatus wherein said secondary resistance means is mounted on the exterior of the housing.

It is another object of the present invention to provide an apparatus wherein the secondary resistance means is a resilient band having a predetermined resistance when stretched.

It is still another object of the present invention to provide an apparatus wherein the secondary resistance means is a plurality of resilient bands each having a predetermined resistance when stretched.

Other objects, advantages and salient features of the invention will become apparent from the following detailed description, which taken in conjunction with the annexed drawings, discloses a preferred, but non-limiting, embodiment of the subject invention.

BRIEF DESCRIPTION OF THE DRAWINGS

FIG. 2 is a partial view of the apparatus of FIG. 1.

FIG. 3 is a plan view of a detail of the apparatus of FIG. 1.

FIG. 4 is a side elevational view of FIG. 3.

FIG. 5 is an end elevational view of the housing assembly of the invention of Figure.

FIG. 6 is a side sectional view of the housing assembly and the resistance mechanism of the present invention.

FIG. 7 is a detail of the resistance mechanism of the present invention.

DESCRIPTION OF THE PREFERRED EMBODIMENTS

Figure 1:
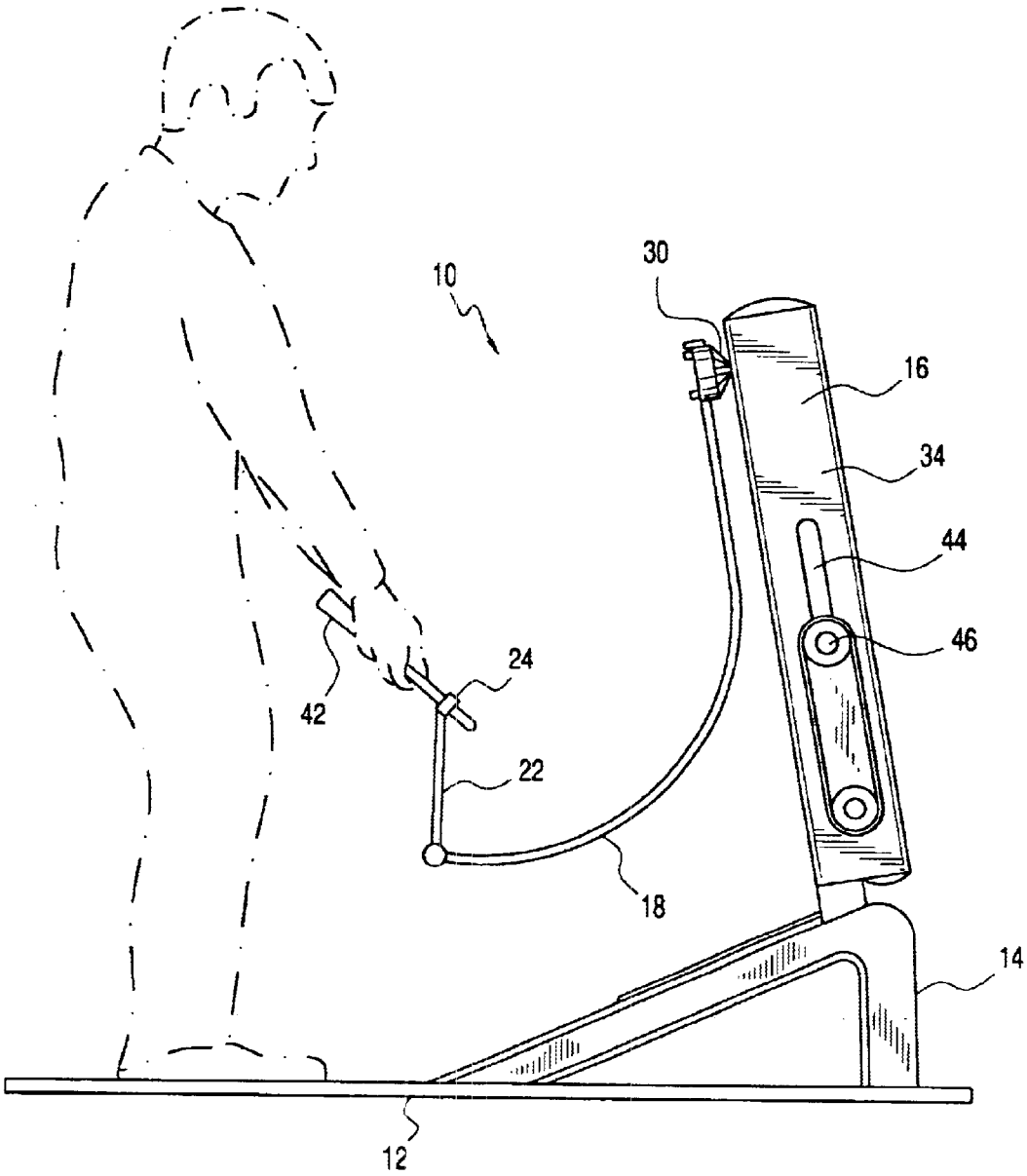
FIG. 1 is shows a side elevational view of a golf swing training apparatus of the present invention.
Figure 8:
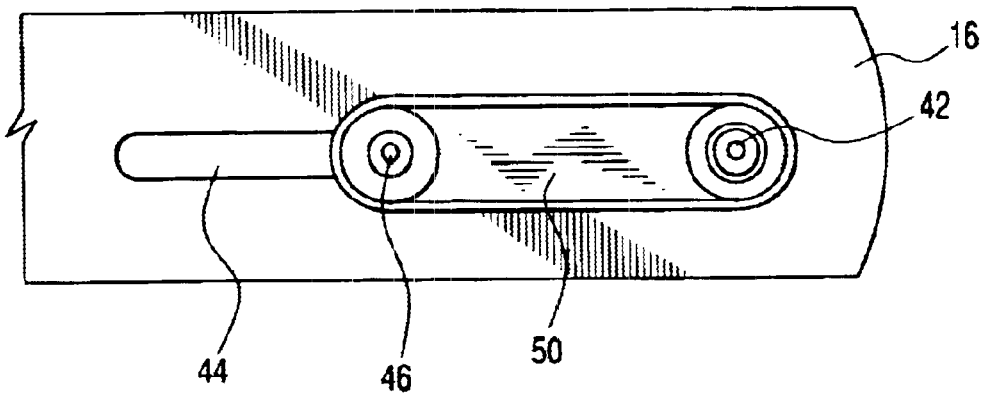
FIG. 8 is a partial view of the invention showing the force bands in a relaxed position.
Figure 9:
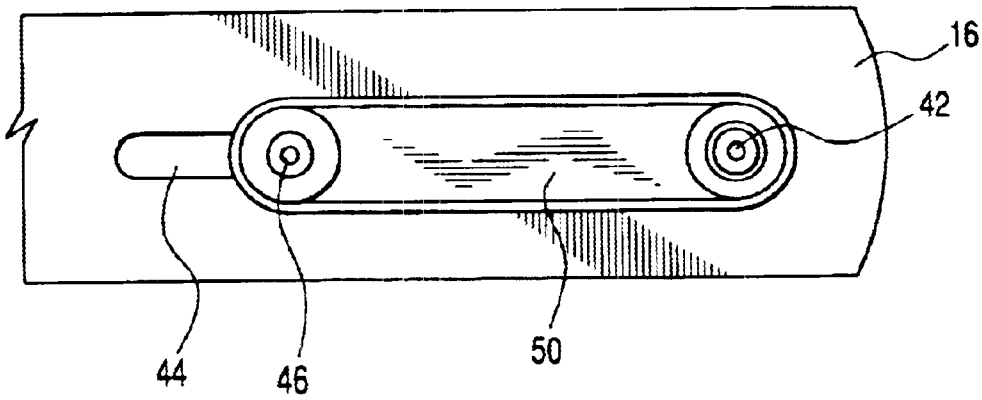
FIG. 9 is a partial view of the invention showing the force bands in an expanded position.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

This invention includes a many of the features described in the U.S. Pat. No. 5,284,464, the disclosure of which is hereby incorporated by reference.

With reference to the drawings, the golf swing trainer and exercise apparatus 10 of the present invention is formed of a base platform 12, a mounting post 14 and an upright housing 16 vertically mounted on the mounting post 14 and secured thereon by means of a hand screw 17. A parabolic swing arm 18 includes a handle 20 connected to a distal end of the swing arm 18 with a flexible linkage 22 and handle connector 24. The opposite end of the parabolic swing arm 18 is connected to a hub 30 which in turn is connected to a hub shaft 32 rotatably mounted within a bearing (not shown) at the top of the housing 16, whereby rotation of the parabolic swing arm 18 rotates the hub shaft 32.

The housing 16 is formed with front and rear walls 34 and 36 and side walls 38 and 40. A fixed force band rod 42 is mounted at the lower end of the housing 16. An elongated slot 44 is formed in each of the side walls 38 and 40, which locates and receives a movable force band rod 46. A secondary resistance system in the form of rubber force bands 50, which provide selected resistance for the apparatus, are mounted between the fixed force band rod 42 and the movable force band rod 46.

FIGS. 3 and 4 illustrate, in detail, the rubber force bands 50 used with the present invention. They are elongated, flexible, resilient, sheets 52 integrally formed with mounting hubs 54 on the ends thereof. Each hub 54 is formed with an aperture 56 sized to fit on and connect with the fixed force band rod 42 and the movable force band rod 46.

Referring to FIGS. 5 and 6, the housing 16 includes a mounting post chamber 58 and a tension mechanism chamber 60. The tension mechanism includes a rotatable sprocket 62 which is fixed to the hub shaft 32 and is rotatable therewith. One end of a chain 64 is connected at a point on the circumference of the rotatable sprocket 62. The opposite end of the chain 64 is fixed to a rod connector 66 which in turn supports the moveable force band rod 46, see FIG. 7. The opposite end of the rod connector 66 connects with the primary resistance spring 68, which in turn, is fixed to the fixed force band rod 42. The rod connector 66 is integral with a movable rod carriage block 70 which slides along the inner wall surfaces 72 and 74 of the housing 16. Preferably a carriage friction plate 76 lines the inner wall surfaces 72 and 74, allowing the movable rod carriage block 70 to freely slide upwardly and downwardly in response to movement of the sprocket 62 and chain 64 connected to the rod connector 66.

In use, a golfer rotates the parabolic swing arm 18 either in a clockwise or counterclockwise motion to simulate a back swing or down swing movement of a golf swing. Either direction of movement rotates the sprocket 62 which in turn causes the chain 64 to wind itself around the circumference of the sprocket 62. This winding movement pulls the rod connector 66 upwardly along with the movable rod carriage block 70 resulting in the movement of the movable force band rod 46 upwardly through the slot 44.

It will be appreciated that the movable force band rod 46 is maintained generally perpendicular to side walls 38 and 40 of the housing 16 as it is supported by the connector 66 and movable carriage block 70. As the movable force band 46 is moved upwardly, the tension of the resistance spring 68 resists the rotatable movement of the swing arm 18, requiring the golfer to exert a substantial force against the resistance, thereby exercising his golf swing muscles. When one or more force bands 50 are connected between the fixed force band rod 42 and the movable force band rod 46, further resistance is added to the golfer performing the exercise.

It will be appreciated that a number of force bands 50 may be used in combination depending on the strength of the golfer, the only requirement being that the force bands be mounted on the fixed force band rod 42 and movable force band rod 46 so as to be movable therewith.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A golf swing training and exercise apparatus for simulating a proper golf swing path and for exercising the golf swing muscles, comprising:

a base;

a housing connected to said base and extending upwardly therefrom;

a primary resistance system and a linkage system supported in said housing, the linkage system being operably connected to the resistance system;

a swing arm having a proximal end rotatably attached to said linkage system and a grip on a distal end thereof;

said linkage system being movable in either a clockwise or counterclockwise direction against said primary resistance system; and, a secondary resistance means removably attached to said apparatus to selectively add additional resistance and to operate in conjunction with said primary resistance system; said secondary resistance means connected between a fixed support attached to said housing and a movable support connected to said linkage in said housing.

2. The apparatus of claim 1, wherein said movable support extends outwardly through said housing.

3. The apparatus of claim 2 wherein said secondary resistance means is mounted on the exterior of said housing.

4. The apparatus of claim 1 wherein said secondary resistance means is a resilient band having a predetermined resistance when stretched.

5. The apparatus of claim 1 wherein said secondary resistance means is a plurality of resilient bands each having a predetermined resistance when stretched.

6. The apparatus of claim 2 wherein said movable support is a block movable within said housing in response to rotation of said swing arm, and, a force band rod attached to said block and movable therewith.

7. The apparatus of claim 6 being further defined by an elongated slot in said housing; said force band rod extending outwardly from said housing through said slot.

8. The apparatus of claim 1 wherein said primary resistance is a spring member and said secondary resistance means is at least one flexible, resilient band having a predetermined resistance when stretched.

* * * * *